United States Patent [19]

Garcia-Mansilla Ripoll

[11] Patent Number: 4,663,907

[45] Date of Patent: May 12, 1987

[54] ANCHORAGE FOR STRESSED REINFORCING TENDON

[75] Inventor: Javier Garcia-Mansilla Ripoll, Madrid, Spain

[73] Assignee: Manufacturas de Acero y Caucho S.A., Spain

[21] Appl. No.: 747,947

[22] Filed: Jun. 24, 1985

[51] Int. Cl.[4] ..... E04C 3/10

[52] U.S. Cl. ..... 52/230; 52/223 L

[58] Field of Search ..... 52/223 L, 223 R, 230; 24/122.6, 115 M, 136 R

[56] References Cited

U.S. PATENT DOCUMENTS

| | | | |
|---|---|---|---|
| 3,137,971 | 6/1964 | Rhodes | 52/230 |
| 3,327,380 | 6/1967 | Howlett | 52/230 |
| 3,351,320 | 11/1967 | Harvey | 52/230 |
| 3,427,772 | 2/1969 | Williams | 52/223 R |
| 3,795,949 | 3/1974 | Shorter | 52/223 R |

FOREIGN PATENT DOCUMENTS

| | | | |
|---|---|---|---|
| 278246 | 7/1965 | Australia | 52/230 |

*Primary Examiner*—Henry E. Raduazo

*Attorney, Agent, or Firm*—Larson and Taylor

[57] ABSTRACT

An anchorage for anchoring a stressed reinforcing tendon to a structural body, which tendon consists of a plurality of stressed elongate elements arranged to lie side-by-side generally in a flat array, has an anchoring means by which the elongate elements are individually anchored to the anchoring body. So that the elements do not interfere with each other, the apertures are arranged in at least two rows each of which is parallel to or in the plane of the said flat array. Preferably the apertures in each row are laterally offset with respect to the apertures of the or each adjacent row. Preferably there are two of said rows of apertures in the anchoring body, offset respectively in opposite directions from the plane of the flat array.

5 Claims, 6 Drawing Figures

ANCHORAGE FOR STRESSED REINFORCING TENDON

BACKGROUND OF THE INVENTION

1. Field of the Invention

This invention relates to an anchorage for anchoring a stressed reinforcing tendon to a structural body, and is particularly concerned with the anchoring of a so-called flat tendon which consists of a plurality of stressed elongate elements arranged to lie side by side generally in a flat array. The invention extends to a structural body having a stressed tendon anchored by at least one anchorage of the invention. By the term "elongate element" herein I mean any element, usually made of steel, which is used for the prestressing of structural bodies or members. Conventionally wire or strand is used, strand being formed by winding a plurality of wires around a single core wire for example seven wire strand or nineteen wire strand. In this specification I shall refer to strand, for convenience, but references to strand can also be taken as reference to the use of wire.

2. Descripiton of the Prior Art

In the construction of post-tensioned concrete slabs, flat tendons are commonly used. FIGS. 1 and of the accompanying drawings show a typical prior art flat tendon anchorage and part of the tendon. For the purpose of illustration, this tendon is shown as composed of four strands 1 of wire, which lie inside a flat sheath 2, whose shape can be seen in FIG. 2 which is a section on the line A—A of FIG. 1. This sheath 2 may also be described as rectangular. Ideally, the strands all lie in a common plane in the sheath 2, but as shown in FIG. 2 there is a tendency for the strands to bunch together in the corners of the sheath, and this arises because the apertures 3 in the anchoring body 4 which receives the strands 1 lie in one line. The strands 1 are individually gripped in the apertures 3 by conventional split conical wedges 5. The strands deviate from one another in a fan shape within the conical trumpet 6 in order to enter the apertures 3.

At the junction of the trumpet 6 and the sheath 2, the strands undergo a lateral (transversal) deflection or bend and therefore tend to bite into each other at this point, which makes it difficult to stress the strands precisely and achieve the desired uniform and accurate tension in the strands.

SUMMARY OF THE INVENTION

The object of this invention is to overcome or at least mitigate the above problem, in particular to provide an anchorage for a stressed reinforcing tendon which permits the elements of the tendon to avoid interference with each other both during and after stressing, thereby to permit more accurate and uniform tensioning of each element.

According to this invention there is provided an anchorage for anchoring a stressed reinforcing tendon to a structural body which tendon consists of a plurality of stressed elongate elements arranged to lie side-by-side generally in a flat array. The anchorage has an anchoring body having a plurality of apertures through which the elongate elements individually extend and anchoring means by which the elongate elements are individually anchored to the anchoring body. The said apertures are arranged in at least two rows each of which is parallel to or in the plane of said flat array.

Preferably the apertures in each row are laterally offset with respect to the apertures of the or each adjacent row. By "laterally offset" I mean offset, i.e. staggered, in the direction of the row i.e. transversely of the flat tendon.

Preferably there are two of said rows of apertures in the anchoring body, offset respectively in opposite directions from the central plane of the flat tendon. In this case all of the tendons are bent out of the plane of the flat tendon in directions normal to the plane. Consequently the tendons do not touch each other, or at least do not significantly interfere with each other, and can be stressed without difficulty. Preferably the amount of lateral offset of the apertures of one row with respect to those of the other row is 50%, i.e. the offset is half the spacing of the apertures in each row.

Instead of using two rows, three rows may be used, in which case the middle one of the rows need not be offset from the plane of the tendon, and the holes in the two outer rows may not be offset with respect to each other though they may both be offset laterally with respect to the apertures of the middle row.

By avoiding lateral bending of the stressed elements, they all enter the sheath or duct parallel to each other and without contacting each other sufficiently to create frictional effects, which otherwise tend to reduce the accuracy of the stressing.

In referring to the plane of the flat tendon or the plane of the sheath, I refer to its central plane close to the anchorage. Over its whole length the tendon may undergo some curvature so that it does not lie entirely in one plane.

In stressing a reinforcing tendon, and using an anchorage of the invention as described above to anchor one end of the tendon after stressing, the elongate elements will normally be stressed individually. However, by avoiding possible interference between the elongate elements of the tendon, the invention makes simultaneous stressing of the elongate elements possible, which may have advantages when long tendons have to be stressed or where double curvature is present in the path of the stressed tendon.

BRIEF INTRODUCTION OF THE DRAWINGS

The preferred embodiments of the invention will now be described by way of non-limitative example with reference to the accompanying drawings, in which.

Figure 1:
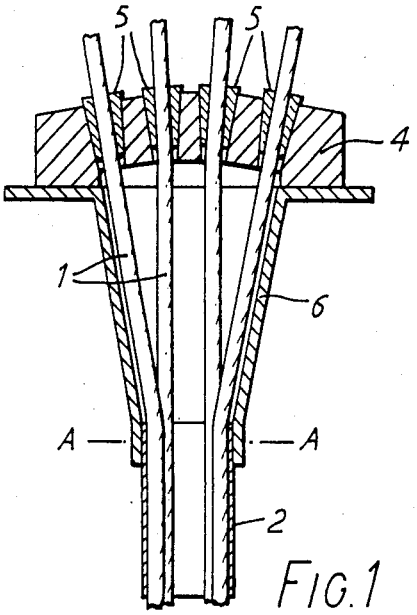
FIG. 1 (PRIOR ART)
FIGS. 1 and 2 illustrate a prior art flat tendon and an anchorage therefor, and have been described above.
Figure 2:
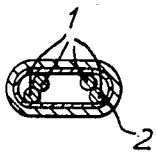
FIG. 2 (PRIOR ART)
Figure 3:
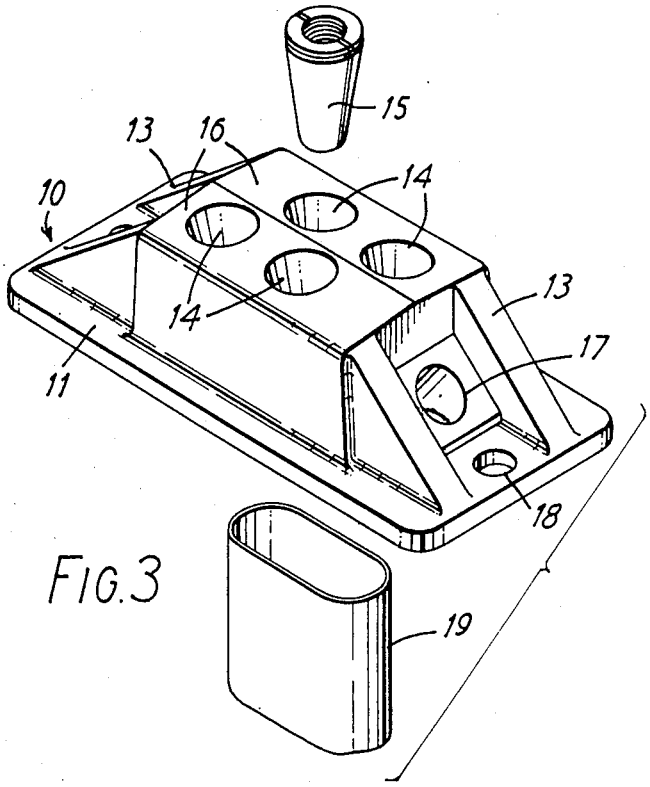
FIG. 3 is an exploded perspective view of parts of the preferred anchorage embodying the invention together with an end of the flat tendon sheath.
Figure 5:
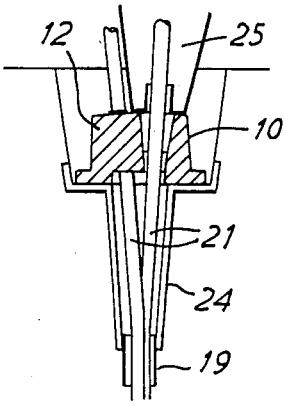
Figure 4A:
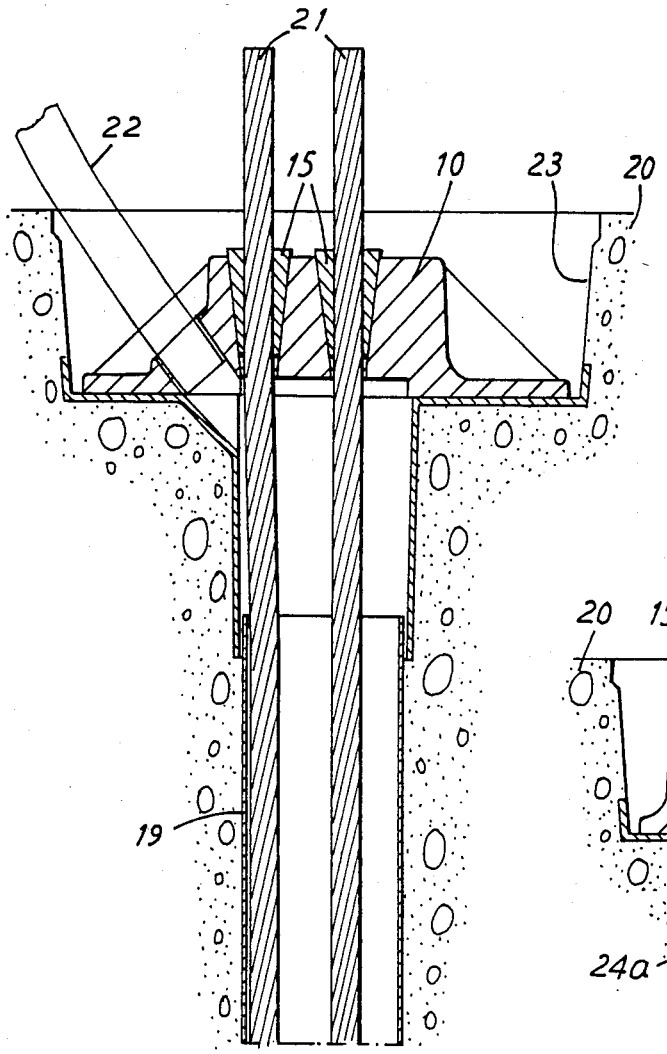
Figure 4B:
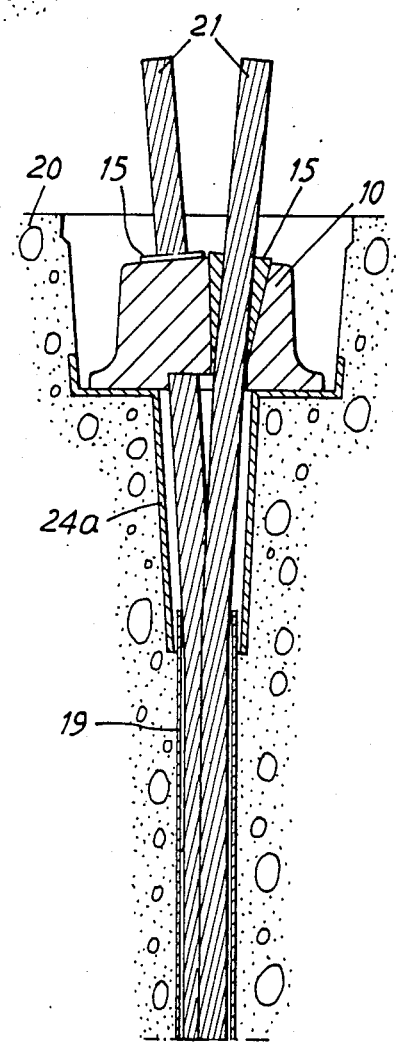

FIGS. 4*a* and 4*b* are respective orthogonal sectional views of the anchorage of FIG. 3 in situ in a concrete member with an anchored tendon; and FIG. 5 shows schematically parts of the anchorage of FIGS. 3 and 4 with a stressing jack applied thereto.

The anchorage embodying the invention shown in FIG. 3 principally consists of a one-piece steel casting 10 forming the anchoring body having a base plate 11 and a large central boss 12 standing up from the base plate and reinforced by four ribs 13. Passing through the anchoring body 10 to emerge at the top of the boss 12 are four frustoconical apertures 14 which receive conventional longitudinally split conical anchoring wedges 15 of which only one is shown for clarity. The wedges 15 lodge in the apertures 14 to grip the strands which pass through the apertures 14. It can be seen that the top face of the boss 12, from which the apertures 14 emerge, has two planar facets which are slightly inclined to each other and to the plane of the base 11 but which are perpendicular to the respective axes of the apertures 14 and thus to the axes of the strands gripped by the wedges 15 in the apertures 14. The body 10 also has a passage 17, by which grouting material can be injected after stressing of the tendon, and apertures 18 for fixing elements. FIG. 3 also shows the end part of a flat sheath 19 for the flat tendon, which as FIGS. 4*a* and 4*b* show is spaced from the anchoring body 10.

FIGS. 4*a* and 4*b* show part of a concrete member 20 in which is embedded the sheath 19 which forms a duct for the stressed flat tendon. The flat tendon is formed from, in this case, four strands 21 (only two are shown in FIG. 4*a* for convenience) which are anchored in the anchoring body 10 by the wedges 15. A tube 22 is shown connected to the passage 17 to inject grout to fill the spaces around the tendon within the sheath 19 and the anchorage after stressing.

The anchoring body 10 is seated within a recess 23 in the concrete body 20 on a lining element 24. The lining element 24, as FIG. 4*b* shows, has a tapering form 24*a* where it connects the recess 23 with the end of the sheath 19. It can be seen from FIGS. 3 and 4 that the apertures 14 in the anchoring body 10 are arranged in two rows each parallel to and spaced from the transverse plane of the sheath 19, with the apertures in each row laterally offset from those in the other row by an amount equal to half the spacing in each row. The two rows correspond to the two facets 16. As a result, as FIG. 4*b* shows, the strands 21 bend in the direction normal to the transverse central plane of the sheath 19 at the end of the sheath so as to pass axially through the apertures 14. Two strands 21 bend in one direction from the central plane of the sheath 19 and two in the other direction from this plane, since the two rows of apertures 14 lie respectively on opposite sides of the central plane of the sheath 19. As FIG. 4*a* shows there is no bending in the plane of the sheath 19. Consequently, during stressing there is no intereference between the strands.

FIG. 5 shows the nose 25 of a single stressing jack applied to one of the facets 16 of the body 10 to stress one of the strands 21. The four strands are stressed in this manner individually. To enable the jack to be applied, the facet 16 must be perpendicular to the axis of the apertures 14. Suitable single stressing jacks are well known.

The illustrated embodiment shows a flat tendon consisting of four strands, so that the anchoring body has two rows of two apertures each. The invention is not restricted to this number of strands or apertures in the anchoring body. More generally the invention extends to all embodiments within the spirit or scope of the following claims.

What is claimed is:

1. An anchorage for anchoring a stressed reinforcing tendon to a structural body which tendon comprises a plurality of stressed elongate elements arranged to lie side-by-side in a generally planar flat array within a correspondingly flat cross-section conduit for the tendon, the width of the conduit in cross-section being less than two times the diameter of an individual element and a plane through the axis of the conduit, parallel to the long sides thereof, constituting the plane of the flat array, said anchorage comprising an anchoring body having extending therethrough a plurality of apertures through which the elongate elements respectively extend, and anchoring means by which the elongate elements are respectively anchored to the anchoring body, said apertures being arranged in at least two rows each of which is parallel to the plane of said flat array and said two rows being located close to the plane of the flat array but being offset equal amounts in opposite directions from the plane of the flat array; the apertures of each row being further offset in the direction of the row with respect to the apertures of the adjacent row, said apertures further being so located in relation to said conduit that substantially no bending of said elements in said plane of the flat array occurs between the conduit and the apertures.

2. An anchorage according to claim 1 wherein said anchoring body has a face comprising a plurality of planar facets at which the apertures of the said rows respectively open, the facets being mutually inclined.

3. An anchorage according to claim 1 wherein the said anchoring body is a one-piece casting.

4. An anchorage according to claim 2 wherein the said anchoring body is a one-piece casting.

5. A structural body having a reinforcing tendon conduit of flat cross-sectional shape, a stressed reinforcing tendon extending along said conduit and at least one anchorage anchoring said tendon to the body, said tendon comprising a plurality of stressed elongate elements arranged to lie side-by-side in a generally planar flat array in said flat-section conduit, the width of the conduit in cross-section being less than two times the diameter of an individual element and a plane through the axis of the conduit parallel to the long sides thereof, constituting the plane of the flat array, and said anchorage comprising an anchoring body engaging said structural body and having extending therethrough a plurality of apertures through which the elongate elements respectively extend, anchoring means by which the elongate elements are respectively anchored to the anchoring body, and said apertures being arranged in at least two rows each of which is parallel to the plane of said flat array and said two rows being located close to the plane of the flat array but being offset equal amounts in opposite directions from the said plane of said flat array; the apertures of each row being further offset in the direction of the row with respect to the apertures of the adjacent row, said apertures further being so located in relation to said conduit that substantially no bending of said elements in said plane of the flat array occurs between the conduit and the apertures.

* * * * *

UNITED STATES PATENT AND TRADEMARK OFFICE

CERTIFICATE OF CORRECTION

PATENT NO. : 4,663,907

DATED : May 12, 1987

INVENTOR(S) : RIPOLL GARCIA-MANSILLA

It is certified that error appears in the above-identified patent and that said Letters Patent is hereby corrected as shown below:

Title page, item [19] should read as follows:

RIPOLL GARCIA-MANSILLA

Title page, item [75] should read as follows:

[75] Inventor: Javier Ripoll Garcia-Mansilla
Madrid, Spain

Signed and Sealed this

Seventh Day of August, 1990

*Attest:*

HARRY F. MANBECK, JR.

*Attesting Officer*

*Commissioner of Patents and Trademarks*